US007443958B2

(12) United States Patent
Harding

(10) Patent No.: US 7,443,958 B2
(45) Date of Patent: Oct. 28, 2008

(54) ELECTRON WINDOW FOR A LIQUID METALANODE, LIQUID METAL ANODE, X-RAY EMITTER AND METHOD FOR OPERATING SUCH AN X-RAY EMITTER OF THIS TYPE

(75) Inventor: Geoffrey Harding, Hamburg (DE)

(73) Assignee: GE Homeland Protection, Inc., Newark, CA (US)

( * ) Notice: Subject to any disclaimer, the term of this patent is extended or adjusted under 35 U.S.C. 154(b) by 9 days.

(21) Appl. No.: 10/599,074

(22) PCT Filed: Mar. 21, 2005

(86) PCT No.: PCT/EP2005/002990

§ 371 (c)(1),
(2), (4) Date: Oct. 2, 2006

(87) PCT Pub. No.: WO2005/091327

PCT Pub. Date: Sep. 29, 2005

(65) Prior Publication Data

US 2007/0177715 A1 Aug. 2, 2007

(30) Foreign Application Priority Data

Mar. 19, 2004 (DE) ..... 10 2004 013 620

(51) Int. Cl.
*H01J 35/08* (2006.01)

(52) U.S. Cl. ..... 378/143; 378/139; 378/140

(58) Field of Classification Search ..... 378/119–143
See application file for complete search history.

(56) References Cited

U.S. PATENT DOCUMENTS 2,665,390 A 1/1954 Zunick et al.
5,052,034 A 9/1991 Schuster
5,105,456 A 4/1992 Rand et al.

(Continued)

FOREIGN PATENT DOCUMENTS

DE 19900467 A1 4/2000

(Continued)

OTHER PUBLICATIONS

David, et al. "Liquid Metal Anode X-Ray Tube," Proceedings of SPIE, vol. 5196, Jan. 2004, pp. 432-443, XP002336484, Bellingham, WA, 2004.*

(Continued)

*Primary Examiner*—Jurie Yun
(74) *Attorney, Agent, or Firm*—GE Global Patent Operation

(57) ABSTRACT

The invention relates to an electron window 1 for a liquid-metal anode 2 in the form of a membrane 4. It is provided according to the invention that the electron window 1 has ridges 10 and depressions 11. In addition, the invention relates to a liquid-metal anode 2 into which such an electron window 1 according to the invention is inserted. The invention further relates to an X-radiator which has a liquid-metal anode 2 according to the invention. The invention also relates to a method for operating a liquid-metal anode 2 in which, during the production of X-radiation, stronger turbulence 5 is produced in the flow of the liquid metal below the electron window 1 at the ridges 10.

12 Claims, 2 Drawing Sheets

U.S. PATENT DOCUMENTS

| | | | | |
|---|---|---|---|---|
| 6,185,277 | B1 | 2/2001 | Harding | |
| 6,477,234 | B2 | 11/2002 | Harding et al. | |
| 6,560,313 | B1 | 5/2003 | Harding et al. | |
| 6,647,094 | B2 | 11/2003 | Harding et al. | |
| 6,735,283 | B2 | 5/2004 | Kutschera et al. | |
| 6,807,248 | B2 | 10/2004 | Mihara et al. | |
| 6,961,408 | B2 * | 11/2005 | Harding et al. | 378/143 |
| 2002/0048344 | A1 | 4/2002 | Bachmann et al. | |
| 2002/0048345 | A1 | 4/2002 | Bachmann et al. | |
| 2003/0058995 | A1 | 3/2003 | Siemens | |
| 2005/0175153 | A1 | 8/2005 | Harding et al. | |

FOREIGN PATENT DOCUMENTS

| | | | |
|---|---|---|---|
| EP | 0584871 | B | 11/1996 |
| EP | 0676772 | A1 | 5/1998 |
| FR | 741148 | A | 2/1933 |
| WO | WO 03/077277 | A | 9/2003 |

OTHER PUBLICATIONS

Li Ping-Wei, et al.: "Applications of Polycapillary X-Ray Optics in Protein Crystallograph," Journal of Applied Crystallograph, vol. 31, Oct. 1998, pp. 806-811, XP0090514.*

* cited by examiner

ELECTRON WINDOW FOR A LIQUID METALANODE, LIQUID METAL ANODE, X-RAY EMITTER AND METHOD FOR OPERATING SUCH AN X-RAY EMITTER OF THIS TYPE

BACKGROUND OF THE INVENTION

The invention relates to an electron window for a liquid-metal anode in the form of a membrane, with a liquid-metal anode which has an electron window according to the invention and an X-radiator with such a liquid-metal anode. The invention also relates to a method for operating an X-radiators with a liquid-metal anode.

Liquid-metal anodes have been used since recently to produce X-ray beams. This technique is called LIMAX (liquid-metal anode X-ray). When producing X-ray beams the liquid-metal anode is bombarded with an electron beam. As a result the liquid-metal anode heats up considerably-like any known solid anode. The heat that forms must be removed from the region of focus in order that the anode does not overheat. This takes place in liquid-metal anodes by means of turbulent mass transport, convection, heat-conduction and electron diffusion processes. In the region of focus in which the electrons strike the liquid-metal anode, the line system of the liquid-metal anode has an electron window. This consists of a thin metal foil or a diamond film which is so thin that in it the electrons lose only a small part of their kinetic energy. In order to be able to remove the heat that forms below the electron window, the liquid metal is circulated in a circuit. The heat that forms at the location of the focus is thus entrained by the liquid metal. The problem arises with the required thin metal foil that it can become unstable or even burst if the liquid pressure or the shearing stress exceed a predetermined mechanical limit.

BRIEF DESCRIPTION OF THE INVENTION

The object of the invention is therefore to provide an electron window which has a higher mechanical stability and at the same time is thin enough to absorb only a very small part of the electron energy. It is also an object of the invention to provide a method with which a liquid-metal anode into which such an electron window is inserted can be operated.

The object is achieved by an electron window with the features of claim 1. Because the membrane has ridges and depressions, for one thing the stability vis-à-vis mechanical stresses, such as the liquid pressure in the line of the liquid-metal anode and the shearing stress, is increased. At the same time, the membrane can also be designed so thin over the predominant part of the surface area that only a low energy loss of the electrons passing through occurs. For another, as a result of the ridges and depressions, turbulence is produced to a greater extent in the flow of the liquid metal below the electron window. A better removal of the heat that forms in the liquid-metal anode upon bombardment with electrons is thereby achieved. All thin items which are stable on the one hand and weaken as little as possible the energy of the electrons passing through them on the other come into consideration as membrane. A metal foil, a diamond film, a ceramic material or a monocrystal, in particular made of cubic boron nitride, are preferably used as membrane. It is also provided according to the invention that the electron window has an embossed structure and both the ridges and the depressions are part-surfaces which are connected to each other via connection flanks. A thin metal foil formed in this way can be produced very easily, as it can be formed from a single part.

The turbulence in the liquid flow of the liquid-metal anode is produced here by the ridges and depressions.

A further advantageous development of the invention provides that the depressions and/or the ridges are arranged in a virtual regular grid structure. It is particularly preferred that the depressions and/or the ridges are formed as polygonal units, in particular square or hexagonal units. Such geometric and symmetrical designs are very simple to produce and give the membrane a particularly high mechanical stability.

A further advantageous development of the invention provides that the electron window is formed bent, in particular like a cut-out section of a cylinder surface. Such a design is firstly very simple to produce and secondly also mechanically very stable.

A further advantageous development of the invention provides that the depressions and/or the ridges are from 10 to 250 μm, preferably 50 μm, high, and the membrane is 5 to 50 μm, preferably 20 μm, thick. As a result of the given height of the depressions and/or ridges, turbulence is produced which lies in the same range of magnitude. This range corresponds substantially to the range of the electrons in the liquid metal, assuming that the electrons are strongly relativistic. Turbulences of a larger size are not necessary, as the heat produced in the liquid metal forms only in the region which the electrons also penetrate.

The object is also achieved by a liquid-metal anode with the features of claim 7. According to the invention, the electron window is inserted into the line such that the ridges point towards the inside of the line and are in contact with the liquid metal. By inserting the electron window with the ridges pointing towards the inside of the line, in addition to the increase in the mechanical stability of the membrane, an increased turbulence in the liquid-metal flow in the liquid-metal anode is also simultaneously achieved, which leads to a better removal of the heat that has formed below the electron window in the region of focus.

The further object is achieved by a method with the features of claim 9. According to the invention, the turbulence is produced at the ridges of the electron window. As a result of the turbulence in the liquid-metal flow, the removal of the heat that forms is—as already stated above—supported in the liquid-metal anode.

BRIEF DESCRIPTION OF THE DRAWINGS

Further details and advantages of the invention are described in more detail with reference to the embodiments represented in the Figures and described below. There are shown in.

DETAILED DESCRIPTION OF THE INVENTION

Figure 1:
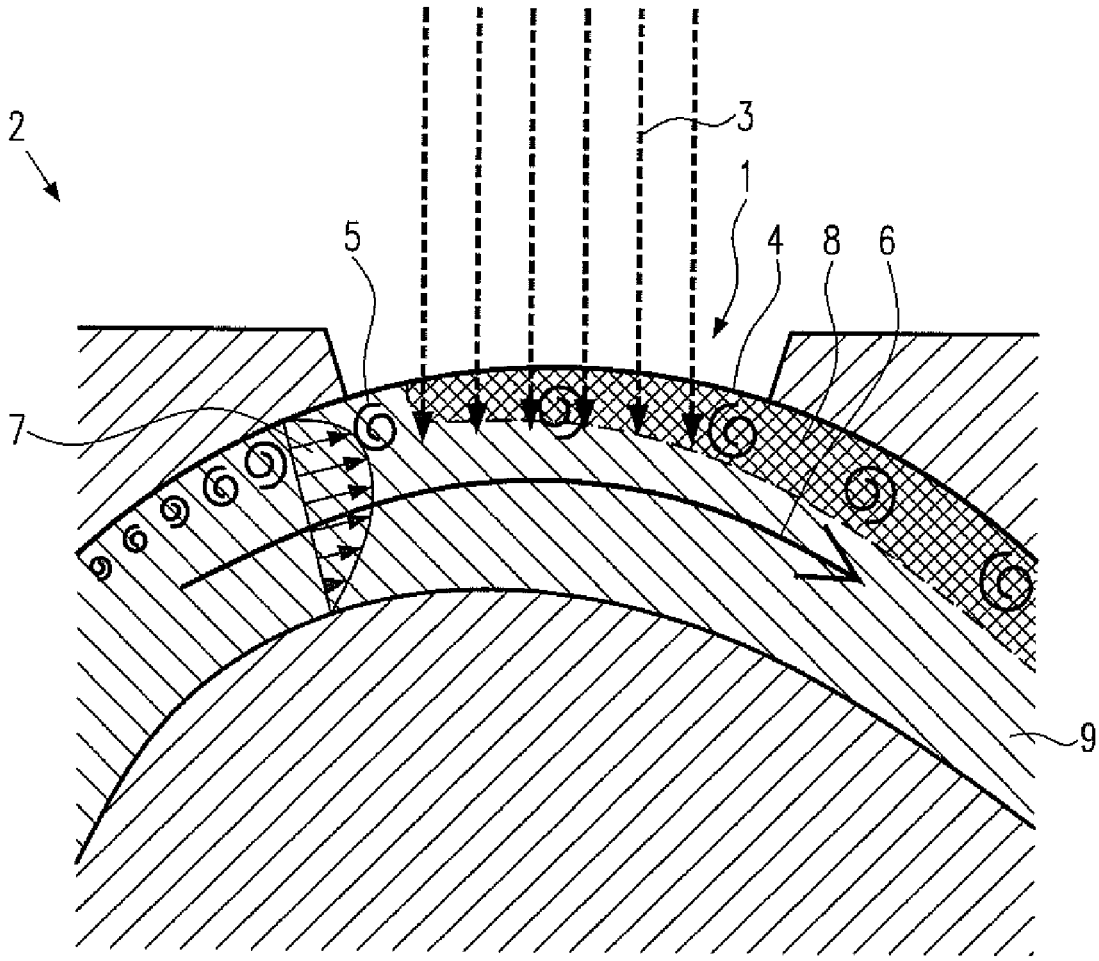
FIG. 1 a schematic section through a liquid-metal anode in the region of focus, FIG. 2 a top view of a first electron window according to the invention, FIG. 3 a view of a second electron window according to the invention and FIG. 4 a longitudinal section through a third electron window according to the invention with ridges and depressions of equal size.

A schematic section through a liquid-metal anode 2 is shown in FIG. 1. Liquid metal is pumped in a line 9 along a direction of flow 6. BiPbInSn for example comes into consideration as liquid metal. In the region of focus of the liquid-metal anode 2, an electron beam 3 strikes an electron window 1 substantially perpendicularly. This electron window 1 is formed as a thin membrane 4 which only slightly weakens the energy of the electrons. The membrane is formed as a thin metal foil 4 in the shown embodiment. It is equally possible to use a diamond film, a ceramic material or a monocrystal, in particular made of cubic boron nitride. The metal foil 4 is so thin that it only slightly slows down the energy of the electron beam 3. It is made from a tungsten alloy, for example W/Re, and is 10 μm thick. However, the optimum thickness depends greatly on the electron energy. The electron energy is absorbed by the liquid metal and X-radiation (not shown) results.

At the same time, in the area in which the electron beam 3 emits its energy to the liquid metal, a heated area 8 forms. The heat of the heated area must be removed to avoid an overheating of the liquid-metal anode 2. The cooling takes place by circulating the liquid metal via a pump (not shown) through the line 9 along the direction of flow 6. The removal of the heat formed takes place by convection, thermal conduction in the liquid metal and electron diffusion.

By means of an electron window 1 according to the invention (for further details, see FIGS. 2 to 4), turbulence 5 is produced to a greater extent in the laminar flow of the liquid metal along the direction of flow 6 as a result of the ridges 10 and the depressions 11. This is illustrated using the flow-rate vector 7. A good removal of the heat formed below the metal foil 4 of the electron window 1 in the direction of flow 6 is thereby achieved. Flow rates of the liquid metal in the range of a few 10 m $s^{-1}$ are sufficient to achieve such a thorough mixing of cold and hot liquid metal, and at the same time obtain a good removal on the basis of the pump capacity.

Figure 2:
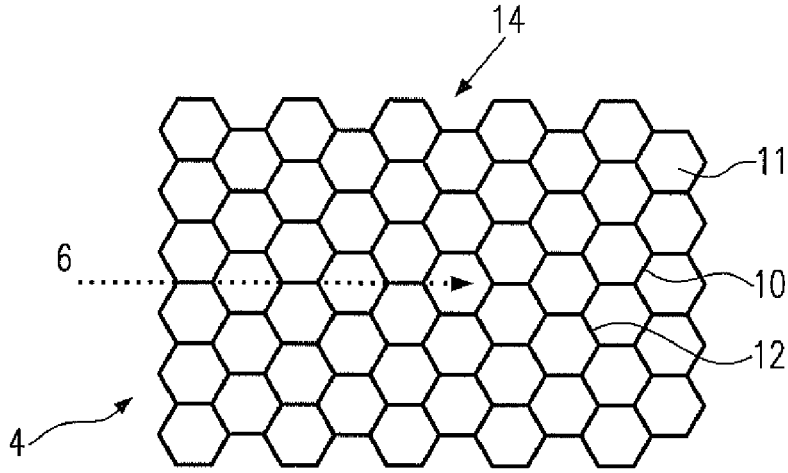
Figure 3:
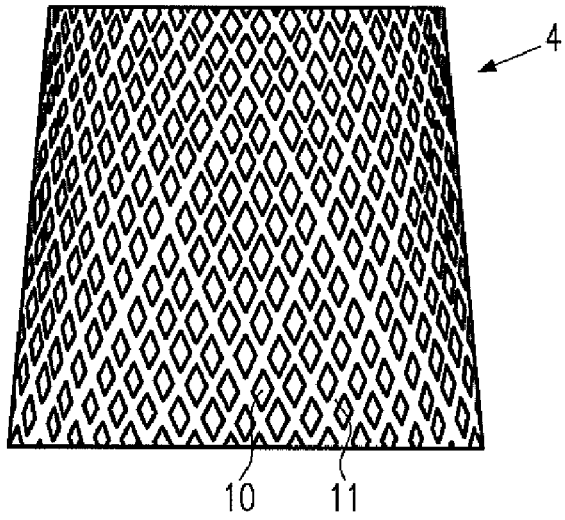
Figure 4:
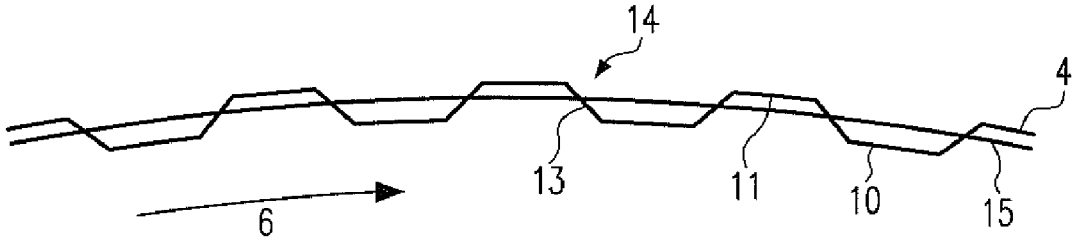

There are shown in FIGS. 2 to 4 three different embodiments of a metal foil 4 according to the invention, which leads on the one hand to the turbulence described above and thus contributes to an improvement of the removal of the heat formed from the heated area 8, but also simultaneously contributes to a substantial increase in the mechanical rigidity of the metal foil 4. This mechanical rigidity is particularly important as it forms the limiting factor for the maximum power at which the X-ray source can be operated. If the mechanical stability of the metal foil 4 is reached or exceeded, this becomes unstable or even bursts as a result of the liquid pressure or the shearing stress. However, metal foils also have a plastic deformation area above the elastic deformation area, resulting in a certain safety zone. This is not the case with a ceramic membrane, as the latter bursts when the elastic deformation area is passed.

A first possibility according to the invention of how the mechanical stability of the metal foil 4 can be increased is shown in FIG. 2. The metal foil 4 is shown here in a top view which corresponds in FIG. 1 seen from below. Thus the shown surface faces the liquid metal of the liquid-metal anode 2 and in contact with same. Hexagonal ribs 12 are formed in the manner of webs on the flat metal foil 4. These are approx. 20 μm high. The ribs 12 thus correspond to ridges 10 which project over the depressions 11 which are defined by the flat metal foil 4. The liquid metal which flows along the direction of flow 6 on the metal foil 4 is swirled to a greater extent by these ribs 12, as is shown in FIG. 1. As a result of the turbulence 5, a good mixing of hot and cold liquid metal is achieved. The size of the turbulence 5 equates approximately to the height of the ribs 12. The hexagonal ribs 12 are arranged on a virtual regular grid structure.

As a result of this two-dimensional ribbed structure, dimensional stability is greatly increased compared with an unstructured, flat metal foil 15 (see FIG. 4). In addition to the hexagonal structure of the ribs 12, other polygonal units are also possible, for example square. The latter are then preferably also arranged on a regular grid structure.

A further embodiment of a metal foil 4 according to the invention is shown in FIG. 3. However, this is formed not on a flat, but on a bent surface. Unlike the embodiment according to FIG. 2, this is a square pattern of ridges 10 and depressions 11. A distorted hexagonal pattern (unlike FIG. 2) is thereby obtained. This corresponds to the familiar thimble which is placed on one's finger for example when sewing.

The third embodiment shown in FIG. 4 of a metal foil 4 according to the invention also has a bent surface. Unlike a flat metal foil 15 (which is shown as reference) with—as shown in the two embodiments of FIGS. 2 and 3 —ribs 12 attached, this metal foil 4 is formed according to a different principle. The shown structure is achieved for example by using an embossing process. It is clear in longitudinal section that the depressions 11 are all arranged on a common surface, essentially lying on a cylinder surface. The ridges 10 also all lie on a cylinder surface, but at a distance from the depressions 11. Adjacent ridges 10 and depressions 11 are connected to each other in each case via a connection flank 13. Such a structure has a self-stabilizing effect so that it has a much higher mechanical stability than the flat metal foil 15 given as reference. The liquid metal which strikes the ridges 10 along the direction of flow 6 is swirled—exactly as described above. The above-named disadvantages for the removal of the heat formed below the electron window 1 thereby result.

It is generally the case that turbulence 5 always involves a mass transport and thus increase the turbulent conductivity relative to the thermal conductivity measured under laminar flow conditions. A liquid-metal anode 2 with an electron window 1 according to the invention thereby makes possible higher electron stream capacities. This property is important in particular in industrial nondestructive analysis in order to reduce the measuring time for inspecting a series of objects.

LIST OF REFERENCE NUMBERS

1 Electron window
2 Liquid-metal anode
3 Electron beam
4 Membrane, in particular metal foil
5 Turbulence
6 Direction of flow
7 Flow-rate vector
8 Heated area
9 Line
10 Ridge
11 Depression
12 Rib
13 Connection flank
14 Virtual grid structure
15 Flat metal foil

What is claimed:

1. An electron window for a liquid-metal anode, the electron window comprising:

a membrane, which has ridges and depressions, wherein the membrane has an embossed structure and a thickness in a range of about 11 μm to about 50 μm, and wherein both the ridges and the depressions are part-surfaces which are connected to each other via connection flanks, wherein the depressions and/or the ridges are one of (a) from about 10 μm to about 95 μm high and (b) from about 105 μm to about 250 μm high.

2. An electron window according to claim 1, wherein the membrane consists of a metal foil, a diamond film, a ceramic material or a monocrystal.

3. An electron window according to claim 2, wherein the membrane is made of cubic boron nitride.

4. An electron window according to claim 1, wherein the depressions and/or the ridges are arranged in a virtual regular grid structure.

5. An electron window according to claim 1, wherein the depressions and/or the ridges are formed as polygonal units.

6. An electron window according to claim 5, wherein the depressions and/or the ridges are formed as square units.

7. An electron window according to claim 5, wherein the depressions and/or the ridges are formed as hexagonal units.

8. An electron window according to claim 1, wherein the electron window is formed bent.

9. An electron window according to claim 8, wherein the electron window is bent like a cut-out section of a cylinder surface.

10. A liquid-metal anode with a pump, a cooling system, a line and a liquid metal which can be pumped through the line by means of the pump, wherein there is arranged in the line an anode module into which an electron window according to claim 1 is inserted, wherein the electron window is inserted into the line such that the ridges point towards the inside of the line and are in contact with the liquid metal.

11. An X-radiator, comprising:

an electron source configured to emit electrons; and a liquid-metal anode according to claim 10 that is configured to emit X-ray beams when struck by the electrons emitted from the electron source.

12. An electron window according to claim 1, wherein the depressions and/or ridges are 50 μm high and the membrane is 20 μm thick.

* * * * *